US007373697B2

(12) United States Patent
Moyer et al.

(10) Patent No.: US 7,373,697 B2
(45) Date of Patent: May 20, 2008

(54) DEVICE FOR SECURING NON-MAGNETIC SHEET MATERIAL

(76) Inventors: Lori A. Moyer, 15 Shore Dr., Wilson, NY (US) 14172; Sandra C. Chido, 3921 Wildwing Dr., North Tonawanda, NY (US) 14120

( * ) Notice: Subject to any disclaimer, the term of this patent is extended or adjusted under 35 U.S.C. 154(b) by 30 days.

(21) Appl. No.: 11/331,742

(22) Filed: Jan. 13, 2006

(65) Prior Publication Data

US 2007/0163090 A1 Jul. 19, 2007

(51) Int. Cl.
*B42F 1/00* (2006.01)
*B43L 3/00* (2006.01)

(52) U.S. Cl. ..... 24/303; 24/67 R

(58) Field of Classification Search ..... 24/303, 24/67 R

See application file for complete search history.

(56) References Cited

U.S. PATENT DOCUMENTS

| | | | | | |
|---|---|---|---|---|---|
| 4,175,340 | A | * | 11/1979 | Deutch | 281/16 |
| 4,255,837 | A | * | 3/1981 | Holtz | 24/303 |
| 4,258,493 | A | * | 3/1981 | Kettlestrings et al. | 40/600 |
| 4,588,209 | A | * | 5/1986 | Zebrowski et al. | 281/45 |
| 4,830,321 | A | | 5/1989 | Irie | 248/206.5 |
| 5,307,579 | A | | 5/1994 | Clayton et al. | 40/600 |
| 5,425,160 | A | * | 6/1995 | Krapf | 24/67 R |
| 6,145,799 | A | | 11/2000 | Khon | 248/442.2 |
| 6,203,230 | B1 | * | 3/2001 | Whang | 402/57 |
| 6,921,073 | B2 | | 7/2005 | Chabot et al. | 273/269 |
| 7,029,740 | B2 | | 4/2006 | Martin | 428/43 |
| 2005/0023420 | A1 | | 2/2005 | Sadeb et al. | |

FOREIGN PATENT DOCUMENTS

| | | |
|---|---|---|
| DE | 29707334 U1 | 6/1997 |
| DE | 29922348 U1 | 3/2000 |
| GB | 1449676 | 5/1973 |
| JP | 08175088 A | 7/1996 |
| JP | 2002151323 | 5/2002 |
| WO | WO 88/04616 | 6/1988 |

* cited by examiner

*Primary Examiner*—Robert J Sandy
(74) *Attorney, Agent, or Firm*—Michael L. Dunn

(57) ABSTRACT

A device for securing non-magnetic sheet material including a first base inferior planar sheet and a second superior planar sheet. Each of the planar sheets include a longitudinally oriented magnetic material, wherein at least one of the planar sheets has permanently magnetized longitudinally oriented magnetic material. The first and second planar sheets are connected by at least one integral hinge passing through a plurality of holes in each of them proximate their respective longitudinal edges such that at least the second planar sheet can be rotated on about a longitudinal axis passing through the hinge so that the second planar sheet can be rotated toward the first planar sheet so that the magnetic materials are attracted to each other to trap the non-magnetic sheet material between them. The longitudinally oriented magnetic material of the second planar sheet runs proximate a second edge of the second planar sheet.

13 Claims, 5 Drawing Sheets

DEVICE FOR SECURING NON-MAGNETIC SHEET MATERIAL

BACKGROUND OF THE INVENTION

This invention relates to a device for securing a non-magnetic sheet material and more particularly relates to securing of materials such as paper and thin card stock of a thickness less than about one millimeter.

Numerous devices and methods for securing sheets of material are well known including tapes, adhesives, clipping devices such as found on clip boards, tacks, rings such as found in ring binders, and magnetic holders such as "refrigerator magnets". All of these devices have disadvantages including one or more of difficulty and time required for use, destruction or modification of the sheet material surface or even the integrity of the material itself, injury to the substrate to which the sheet is held, inability of reuse, complexity and expense, requirement for special, e.g. bulletin board or magnetic, substrates, insufficient holding power, inability to simultaneously organize a plurality of sheets on a surface and loss of integrity or breakage over a short sequence of uses even when reuse is possible.

Use of Bingo cards is one particular example needing low expense, simplicity, speed of use, holding power, ability to organize a plurality of sheets, requirement for non-injury to the substrate or sheet, and frequent repetitive use without breakage. Historically, Bingo cards were taped to a table requiring time, wasting tape, and causing injury to the card and often to the table.

U.S. Patent Publication US 2004/0135315 A1 published Jul. 15, 2004, provides an example of an improved device for securing and organizing Bingo cards. The device is made from a single plastic sheet to which is attached a ferromagnetic strip and a magnetic strip such that when the plastic sheet is folded, a non-magnetic sheet material can be held or clamped between the ferromagnetic strip and magnetic strip. The device, nevertheless has serious disadvantages. In particular, after repeated use, the plastic material will crack at the fold to permit the ferromagnetic strip and magnetic strip to approach each other. Furthermore, the magnetic strip is not at the edge of the plastic sheet thus causing both the magnetic strip and a portion of the plastic sheet to obscure a significant portion of a retained non-magnetic sheet. To overcome this serious disadvantage, the device of US 2004/0135315 A1 prints the "BINGO" bingo card top line designations on the device. Unfortunately, this requires time consuming and annoying precise alignment with the card and since all cards are not of exactly the same size, such alignment is not always possible. Furthermore, such printed designations prevent the device from being practically used when sheet material other than bingo cards are to be secured.

BRIEF DESCRIPTION OF THE INVENTION

Figure 1:
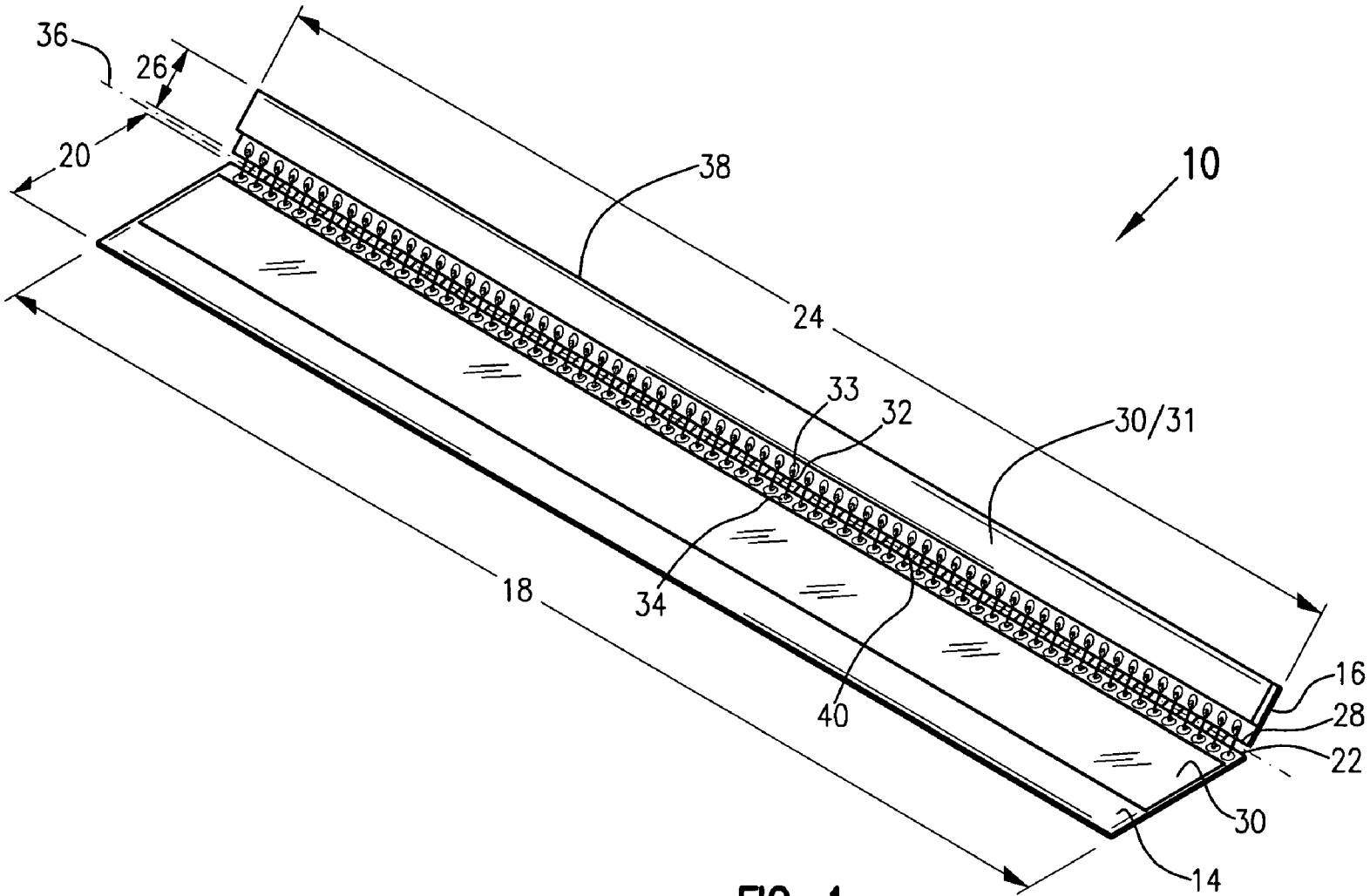
FIG. 1 is a perspective view of a preferred embodiment of a device of the invention in a partially open position using a spiral type hinge.
Figure 2:
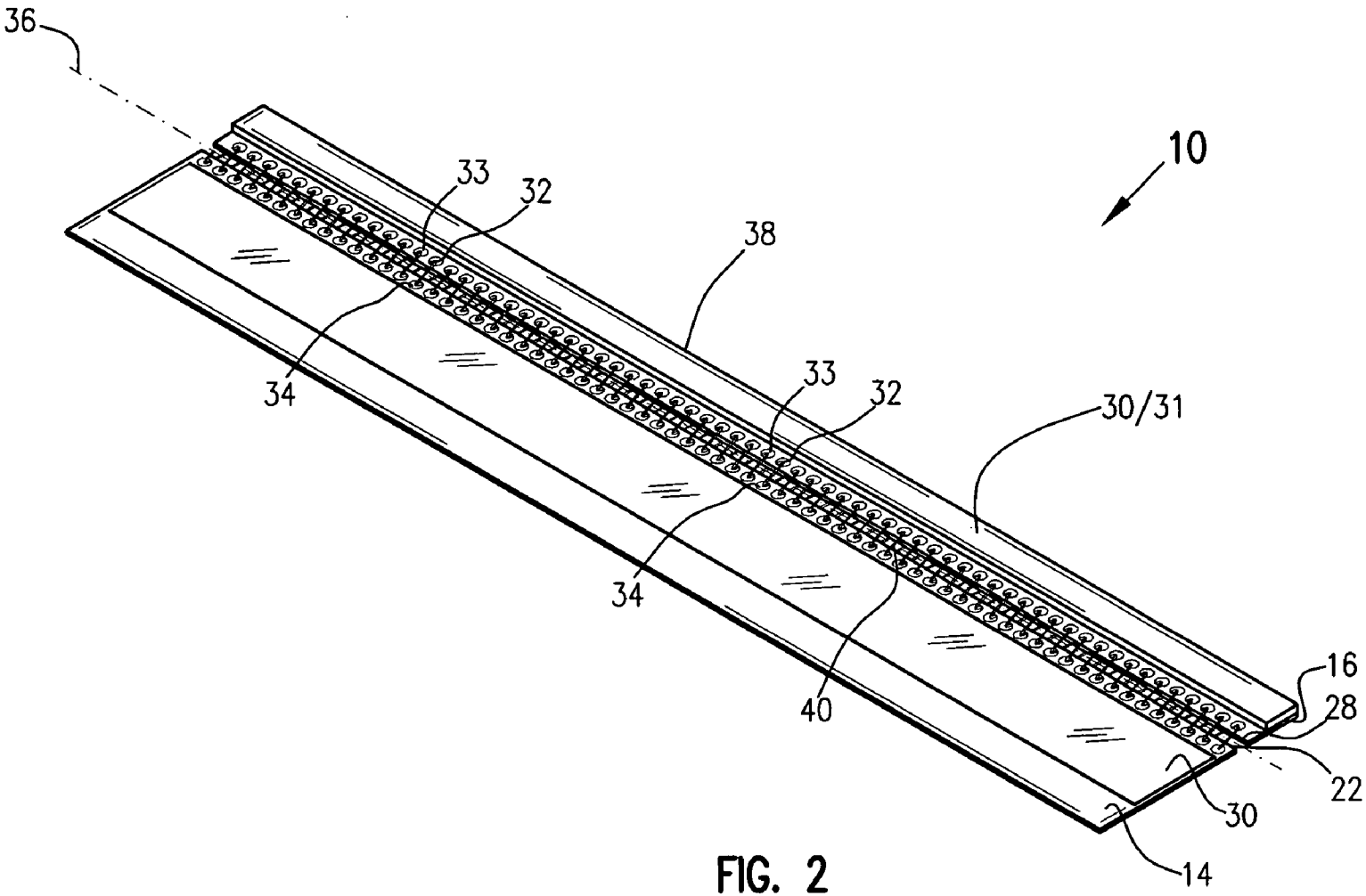
FIG. 2 shows the device of FIG. 1 in an open position.

In accordance with the invention an improved device is provided for securing non-magnetic sheet material having a thickness of less than about one millimeter. It is to be understood that a stack of such non-magnetic sheets can be used if the combined thickness is less than about one millimeter. The device includes a first base inferior planar sheet and a second superior planar sheet. The first and second planar sheets have longitudinal lengths that vary from each other by less than fifteen percent. The first planar sheet has an aspect ratio of Longitudinal dimension to Perpendicular dimension of between 20:1 and 0.6:1 and has at least one essentially linear first planar sheet longitudinal edge parallel to the Longitudinal dimension. The second planar sheet has an aspect ratio of Longitudinal dimension to Perpendicular dimension of from about 40:1 to about 15:1 where the second superior planar sheet aspect ratio is always greater than the first planar sheet aspect ratio and has at least one essentially linear second planar sheet first longitudinal edge parallel to its Longitudinal dimension. Each of the planar sheets include a longitudinally oriented magnetic material, wherein at least one of the planar sheets has permanently magnetized longitudinally oriented magnetic material. The first and second planar sheets are connected by at least one integral hinge passing through a plurality of holes in each of them proximate their respective longitudinal edges such that at least the second planar sheet can be rotated on about a longitudinal axis passing through the hinge so that the longitudinally oriented magnetic material of the second planar sheet can be rotated toward the longitudinally oriented magnetic material of the first planar sheet so that the magnetic materials are attracted to each other to trap the non-magnetic sheet material between the first and second planar sheets to secure the non-magnetic sheet between them. The longitudinally oriented magnetic material of the second planar sheet runs proximate a second edge of the second planar sheet opposite the first edge of the second planar sheet so that the second planar sheet does not obscure a significant portion of the non-magnetic sheet material beyond the longitudinally oriented magnetic material of the second planar sheet.

DETAILED DESCRIPTION OF THE INVENTION

"Longitudinal dimension", as used herein, means the dimension in a direction parallel to the axis of the hinge of the device.

"Perpendicular dimension", as used herein, means the dimension in a direction perpendicular to the Longitudinal dimension.

"magnetic", as used herein, means a material that is permanently magnetized.

"ferro-magnetic", as used herein, means a material that is attracted by a Magnetic material.

"non-magnetic", as used herein, means a material that is not attracted by a Magnetic material.

Non-magnetic sheet material to be retained by the device of the present invention is any non-magnetic sheet material having a thickness of less than about one millimeter and usually having a thickness of from about 0.05 (e.g. tissue) to about 0.4 millimeter (e.g. heavy bristol card stock). The sheet material may, for example, be one or more sheets of paper, plastic film, leather, woven or non-woven cloth or ceramic. The non-magnetic sheet material may, for example, be bingo cards, photographs, children's drawings, news clippings, documents, letters, recipes, posters, phone messages, artwork, classwork, calendars, schedules, patterns, and lists.

The back of the device may be secured to a horizontal or vertical surface to obtain a semi-permanent location to secure non-magnetic sheet material, e.g. to a tabletop desktop, refrigerator, wall or typing stand for providing a conveniently readable location for typing wherein the document can be readily removed and replaced.

The first base inferior planar sheet may be of any shape retaining ferro-magnetic or non-magnetic sheet material such as a ferro-magnetic sheet metal, plastic, or wood. The base inferior planar sheet is usually from about 0.1 to about 1 mm in thickness and most commonly from about 0.15 to about 0.5 mm in thickness. The base inferior planar sheet may have an aspect ratio of Longitudinal dimension to Perpendicular dimension of from about 20:1 to about 0.6:1. The aspect ratio of the first planar sheet is preferably from about 9:1 to about 7:1, where a small device that can be easily carried is desired or from about 0.85:1 to about 0.7:1 when the size of the first planar sheet is about the size of an 8.5×11 inch sheet of paper.

The second superior planar sheet may be of any shape retaining magnetic, ferro-magnetic or non-magnetic sheet material such as a Magnetic sheet metal, Magnetic matrix material including Magnetic powder in a polymer matrix, ferro-magnetic sheet metal, plastic, or wood. The second superior planar sheet is usually from about 0.1 to about 1 mm in thickness and most commonly from about 0.15 to about 0.5 mm in thickness. The second superior planar sheet may have an aspect ratio of Longitudinal dimension to Perpendicular dimension of from about 40:1 to about 15:1, preferably from about 30:1 to about 20:1, where the second superior planar sheet aspect ratio is always greater than the first planar sheet aspect ratio. The first and second planar sheets have Longitudinal dimensions that vary from each other by less than fifteen percent. The first planar sheet has first planar sheet first longitudinal edge parallel to its Longitudinal dimension and the second planar sheet has first planar sheet first longitudinal edge parallel to its Longitudinal dimension. Each of the first and second planar sheets include ferro-magnetic material along their respective Longitudinal edges, which ferro-magnetic material may be inherent within the material of the planar sheet or may be attached to the planar sheet. Ferro-magnetic material of at least one of the planar sheets being permanently magnetized longitudinally oriented magnetic material.

The first and second planar sheets are connected by a spiral hinge passing through holes in each of them proximate their respective longitudinal edges such that at least said second planar sheet can be rotated on the hinge on an axis proximate the longitudinal edges so that the longitudinally oriented magnetic material of the second planar sheet can be rotated toward the longitudinally oriented magnetic material of the first planar sheet so that the magnetic materials are attracted to each other to trap the non-magnetic sheet material between the first and second planar sheets to secure the non-magnetic sheet between them.

The longitudinally oriented magnetic material of the second planar sheet preferably runs proximate a second edge of the second planar sheet opposite the first edge of the second planar sheet so that the second planar sheet does not obscure a significant portion of the non-magnetic sheet material beyond the longitudinally oriented magnetic material of the second planar sheet.

The invention may be more fully understood by reference to a preferred embodiment shown in the drawings wherein an improved device 10 is provided for securing non-magnetic sheet material 12 having a thickness of less than about one millimeter. The device 10 includes a first base inferior planar sheet 14 and a second superior planar sheet 16. The first and second planar sheets, 14 and 16 have Longitudinal dimensions that vary from each other by less than fifteen percent. The first planar sheet has an aspect ratio of first planar sheet Longitudinal dimension 18 to its Perpendicular dimension 20 of between about 20:1 and about 0.6:1 and has at least one essentially linear first planar sheet longitudinal edge 22 parallel to the Longitudinal dimension 18. The second planar sheet has an aspect ratio of second planar sheet Longitudinal dimension 24 to its Perpendicular dimension 26 of from about 40:1 to about 15:1 where the second superior planar sheet aspect ratio is always greater than the first planar sheet aspect ratio and has at least one essentially linear second planar sheet first longitudinal edge 28 parallel to its Longitudinal dimension 28. Each of the planar sheets include a longitudinally oriented ferro-magnetic material 30, wherein at least one of the planar sheets 14 and 16 includes permanently magnetized longitudinally oriented magnetic material 31. The first and second planar sheets 14 and 16 are connected by at least one integral hinge 32 passing through a plurality of holes 33 and 34 in each of them proximate their respective longitudinal edges 22 and 28 such that at least the second planar sheet 16 can be rotated on about a longitudinal axis 36 passing through the hinge 32 so that the longitudinally oriented magnetic material 30 of the second planar sheet 16 can be rotated toward the longitudinally oriented ferro-magnetic material 30 of the first planar sheet 12 so that the ferro-magnetic materials 30 are attracted to each other to trap the non-magnetic sheet material 12 between the first and second planar sheets 14 and 16 to secure the non-magnetic sheet 12 between the nm. The longitudinally oriented magnetic material 31 of the second planar sheet 16 runs proximate a second edge 38 of the second planar sheet 16 opposite the first edge 28 of the second planar sheet 16 so that the second planar sheet 16 does not obscure a significant portion of the non-magnetic sheet material 12 beyond the longitudinally oriented magnetic material 30 of the second planar sheet 16.

Figure 8:
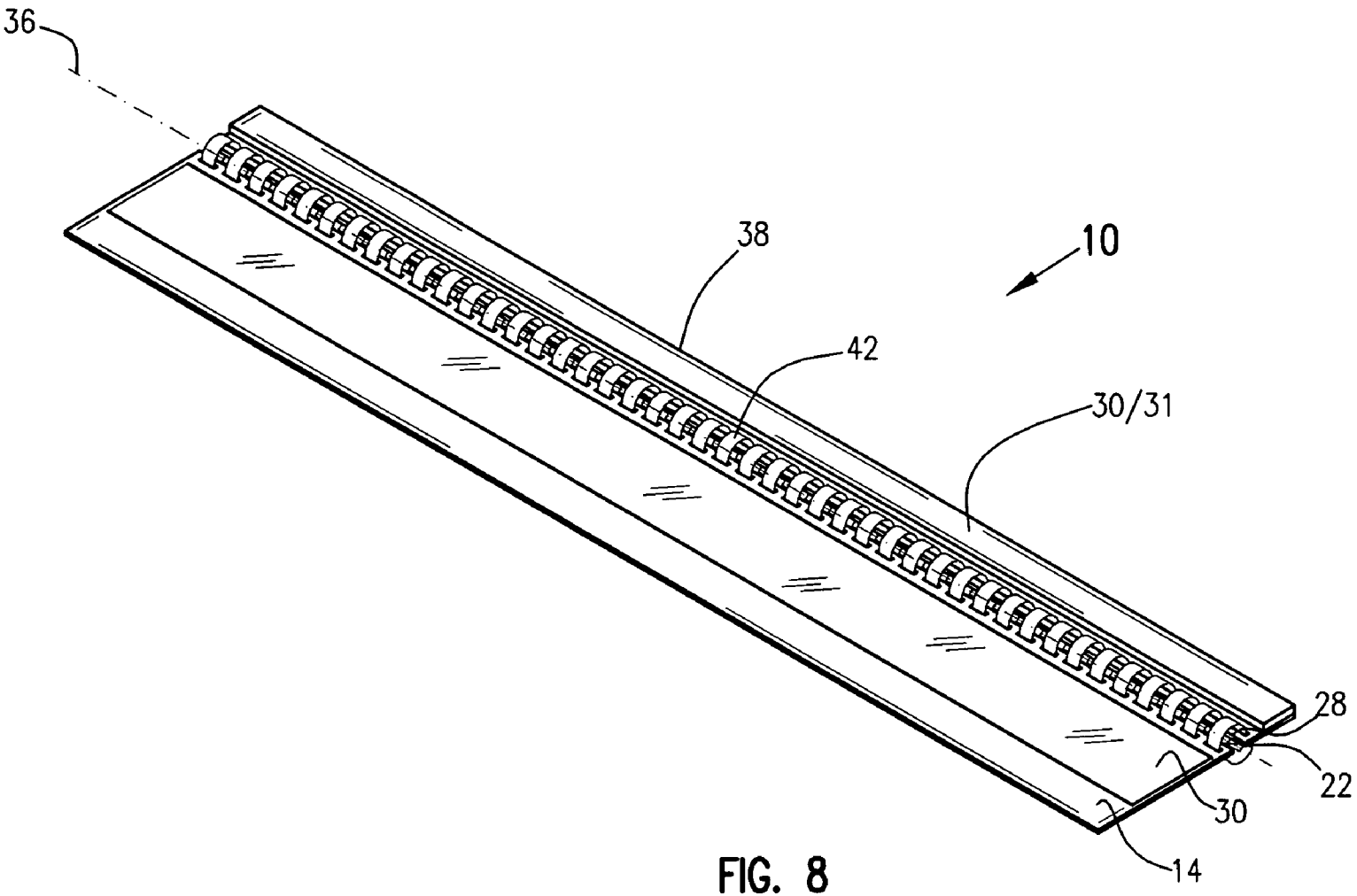
FIG. 8 shows an alternative preferred embodiment of the invention in the open position using a comb type hinge.

The hinge 32 is preferably an integral spiral 40 or a hinge comb 42 as shown in FIG. 8. The integral hinge is integral in the sense that components of the hinge that pass through holes in the first and second planar sheets are interconnected thus giving the hinge linear integrity. While a single such hinge is preferred, it is to be understood that a series of such integral hinges can be used on the same axis.

Operation of the device of the invention is best understood by reference to FIGS. 3-6 of the drawings.

Figure 3:
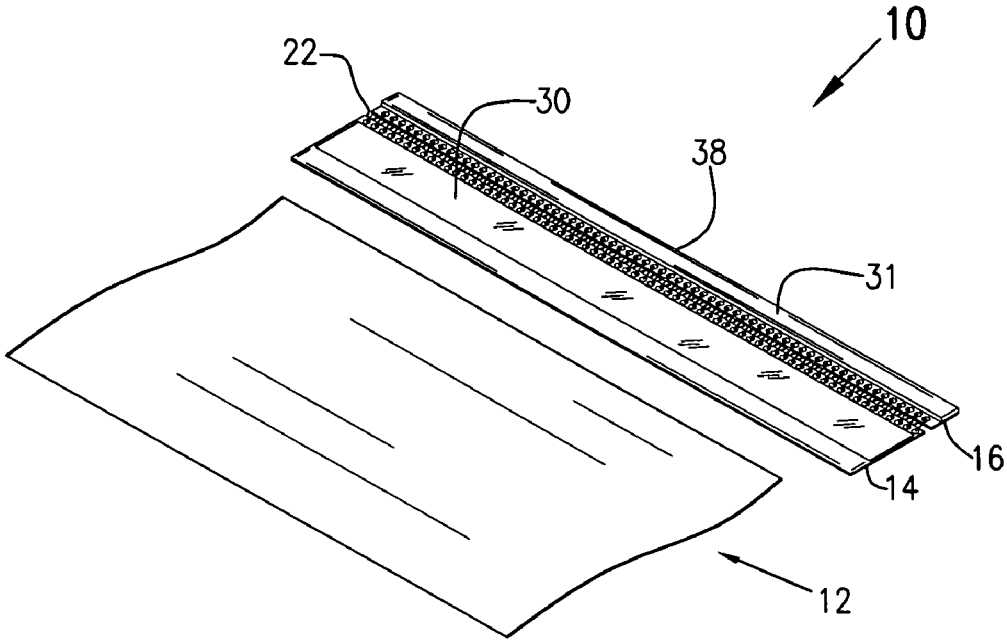
FIG. 3 shows the device of FIG. 2 in conjunction with a non-magnetic sheet material to be retained by the device.
Figure 4:
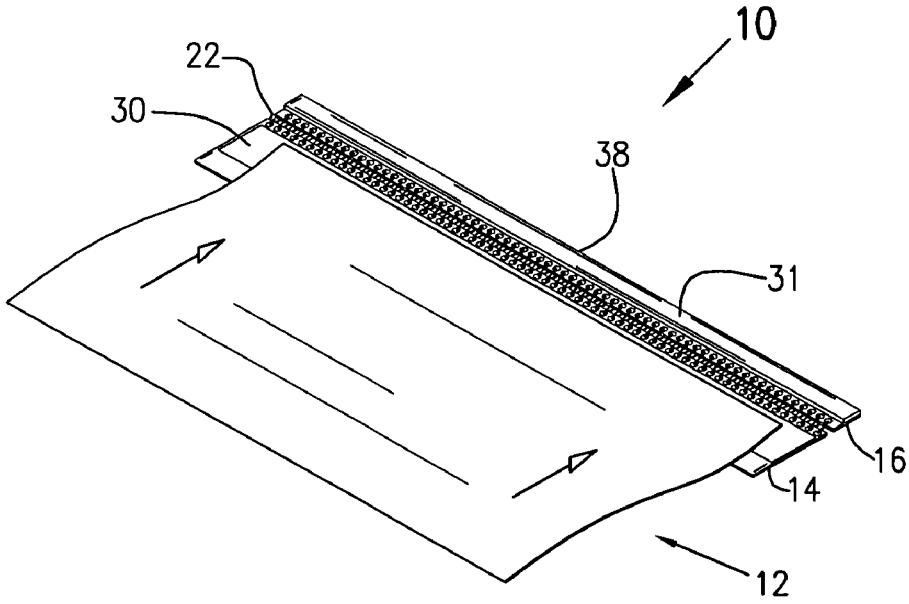
FIG. 4 shows the device of FIG. 3 with the non-magnetic sheet material lain upon a first planer sheet of the device.
Figure 5:
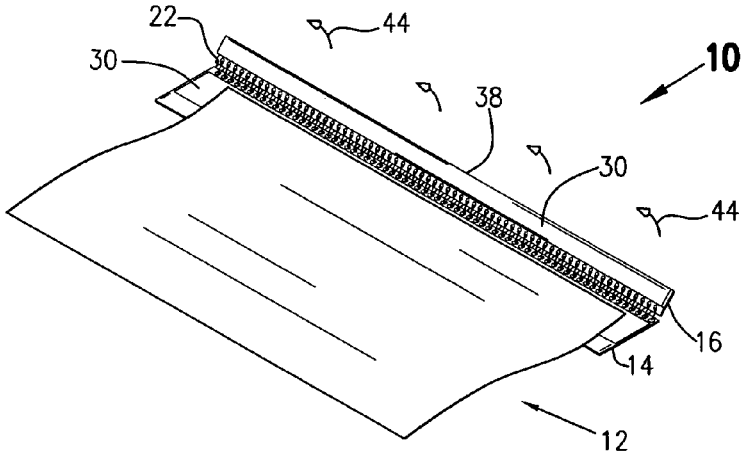
FIG. 5 shows the device of FIG. 4 with the device in the process of closing by rotation of the second planar sheet about the hinge.
Figure 6:
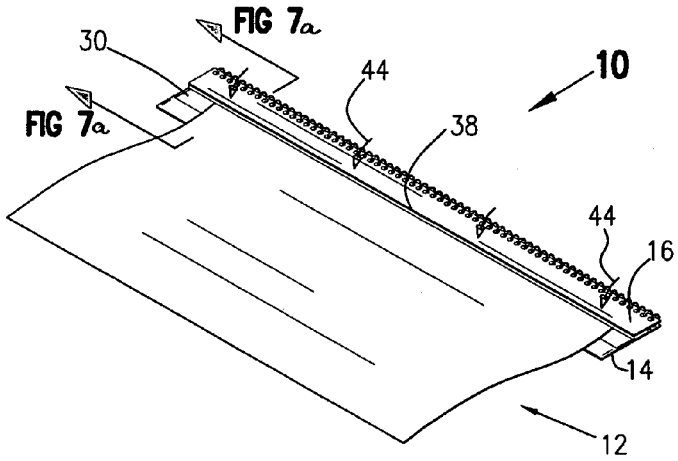
FIG. 6 shows the device of FIG. 5 in a closed position retaining the non-magnetic sheet material.

As seen in FIGS. 3 and 4 first and second planar sheets 14 and 16 are rotated about hinge 32/42 to an open position and a non-magnetic sheet material 12 is placed on first planar sheet 14. Second planar sheet 16 is then rotated about hinge 32/42 in direction 44 as best seen in FIGS. 5 and 6 so that ferro-magnetic surfaces 30 attract each other due to at least one of ferro-magnetic surfaces 30 being a magnetic surface 31 so that non-magnetic sheet material 12 is retained.

Non-magnetic sheet material 12 is readily removed by reversing the operation. As previously discussed, a plurality or stack of sheet material may be used provided that the combined thickness does not so attenuate magnetic holding power that the sheets are not securely held. Such combined thickness may for example be about one millimeter.

Figure 7A:
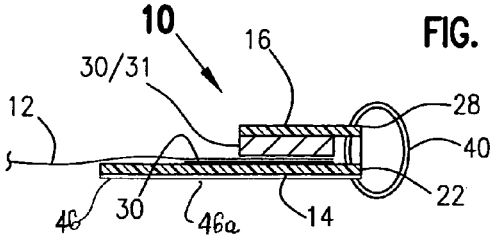
FIG. 7*a* shows a cross section of the device as taken on lines 7-7 of FIG. 6.
Figure 7B:
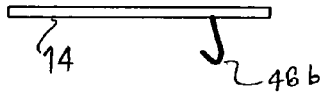
FIG. 7*b* is a cross-sectional view of an alternate embodiment of the device in FIG. 6.

As best seen in FIGS. 7*a* and 7*b*, a securer 46 may be attached to the back of first plannar sheet 14 for securing the device to a substrate. The securer may, for example, be in the form of an adhesive 46*a* or a hook 46*b*.

What is claimed is:

1. A device for securing non-magnetic sheet material having a thickness of less than about one millimeter, said device comprising a first base inferior planar sheet and a second superior planar sheet said first and second planar sheets having longitudinal dimensions, parallel to a longitudinal axis of at least one hinge connecting the planar sheets, that vary from each other by less than fifteen percent, said first planar sheet having an aspect ratio of longitudinal dimension to a perpendicular dimension perpendicular thereto of between about 20:1 and about 0.6:1 and having at least one essentially linear first planar sheet longitudinal edge parallel to the longitudinal axis of the hinge and said second planar sheet having an aspect ratio of longitudinal dimension to a perpendicular dimension perpendicular thereto of from about 40:1 to about 15:1 where the second planar sheet aspect ratio is always greater than the first planar sheet aspect ratio and having at least one essentially linear second planar sheet first longitudinal edge parallel to the longitudinal axis of the hinge, each of said planar sheets comprising ferro-magnetic material, wherein at least one of the planar sheets comprises permanently magnetized ferro-magnetic material, said first and second planar sheets being connected by the at least one hinge passing through holes in each of said planar sheets proximate their respective longitudinal edges such that at least said second planar sheet can be rotated on said hinge on an axis proximate said longitudinal edges so that the ferro-magnetic material of the second planar sheet can be rotated toward the ferro-magnetic material of the first planar sheet so that the ferro-magnetic materials are attracted to each other to trap the non-magnetic sheet material between the first and second planar sheets to secure the non-magnetic sheet between them, the ferro-magnetic material of the second planar sheet running proximate a second edge of the second planar sheet opposite the first edge of the second planar sheet so that the second planar sheet does not obscure a significant portion of the non-magnetic sheet material beyond the ferro-magnetic material of the second planar sheet.

2. The device of claim 1 where the hinge is a spiral hinge.

3. The device of claim 1 where the hinge is a comb type hinge having a supporting back from which curved binding members extend.

4. The device of claim 1 where the planar sheets consist essentially of ferro-magnetic material.

5. The device of claim 1 wherein the device comprises a laminate of at least one of the planar plastic sheets with at least one of the ferro-magnetic materials.

6. The device of claim 1 wherein the ferro-magnetic material of the second planar sheet is magnetic material.

7. The device of claim 1 wherein the aspect ratio of the second planar sheet is from about 20:1 to about 30:1.

8. The device of claim 7 where the aspect ratio of the first planar sheet is from about 9:1 to about 7:1.

9. The device of claim 7 where the aspect ratio of the first planar sheet is from about 0.85:1 to about 0.7:1.

10. The device of claim 9 wherein a securer is attached to a back of the first planar sheet for securing the device to a substrate.

11. The device of claim 10 where the securer comprises a hook.

12. The device of claim 11 where the securer comprises an adhesive.

13. The device of claim 1 where the ferro-magnetic material of the second planar sheet has an edge that runs coextensively with the second edge of the second planar sheet.

* * * * *